US009171515B2

(12) United States Patent
Huang

(10) Patent No.: US 9,171,515 B2
(45) Date of Patent: Oct. 27, 2015

(54) LIQUID CRYSTAL PANEL, SCANNING CIRCUIT AND METHOD FOR GENERATING AND UTILIZING ANGLE WAVES TO PRE-CHARGE SUCCEEDING GATE LINE

(71) Applicant: CHUNGHWA PICTURE TUBES, LTD., Padeh, Taoyuan (TW)

(72) Inventor: Chang Xin Huang, Taipei (TW)

(73) Assignee: CHUNGHWA PICTURE TUBES, LTD., Padeh, Taoyuan (TW)

( * ) Notice: Subject to any disclaimer, the term of this patent is extended or adjusted under 35 U.S.C. 154(b) by 212 days.

(21) Appl. No.: 13/935,374

(22) Filed: Jul. 3, 2013

(65) Prior Publication Data

US 2014/0218346 A1 Aug. 7, 2014

(30) Foreign Application Priority Data

Feb. 1, 2013 (TW) ..... 102103932 A

(51) Int. Cl.
*G09G 3/36* (2006.01)

(52) U.S. Cl.
CPC ..... *G09G 3/3677* (2013.01); *G09G 2310/0251* (2013.01); *G09G 2310/0286* (2013.01); *G09G 2310/0289* (2013.01)

(58) Field of Classification Search
CPC ..... G09G 2310/0289; G09G 2310/0286
See application file for complete search history.

(56) References Cited

U.S. PATENT DOCUMENTS 8,098,792 B2 1/2012 Hsu et al.
2008/0084408 A1 * 4/2008 Nishimura ..... 345/205

FOREIGN PATENT DOCUMENTS

TW 201140547 11/2011
TW 201239858 10/2012

* cited by examiner

*Primary Examiner* — Quan-Zhen Wang
*Assistant Examiner* — Chad Dicke
(74) *Attorney, Agent, or Firm* — Muncy, Geissler, Olds & Lowe, P.C.

(57) ABSTRACT

A liquid crystal panel, a scanning circuit and a method for generating angle waves are provided. A scanning circuit for generating angle waves includes a scanning module and a plurality of angle wave modules. The scanning module has a plurality of scan output ends for outputting scan driving signals respectively in order, wherein the scan driving signal includes a first voltage and a second voltage. The angle wave modules are electrically connected to the scan output ends respectively in order; wherein a second output end of each angle wave module is electrically connected a first output end of next one of the angle wave modules, whereby a part of electrical energy received by the second output end of the angle wave modules is transmitted to the first output end of the next one of the angle wave modules.

8 Claims, 4 Drawing Sheets

LIQUID CRYSTAL PANEL, SCANNING CIRCUIT AND METHOD FOR GENERATING AND UTILIZING ANGLE WAVES TO PRE-CHARGE SUCCEEDING GATE LINE

CROSS-REFERENCE TO RELATED APPLICATION

This application claims the benefit of Taiwan Patent Application No. 102103932, filed on Feb. 1, 2013, which is hereby incorporated by reference for all purposes as if fully set forth herein.

BACKGROUND OF THE INVENTION

1. Field of Invention

This invention relates to a liquid crystal panel, a scanning circuit and a method for generating angle waves, and more particularly to a liquid crystal panel, a scanning circuit and a method can generate angle waves by using a voltage dividing manner.

2. Related Art

By transmitting start signals (i.e., gate driving signal) to gate lines of a typical liquid crystal panel respectively, semiconductor channel layers of thin film transistor (TFT) elements can be energized to control a suitable charge time of liquid crystal units corresponding to the gate lines, and then each pixel data signal is transmitted from a source electrode to a drain electrode through the energized semiconductor channel layer so as to charge the liquid crystal units. When the liquid crystal units are charged, the waveforms of the start signals are deformed because the number of the liquid crystal units is gradually increased so as to cause the start signals to be affected by an electrical impedance of the increased liquid crystal units. The deformed waves of the start signals can cause electrical charges to be different when the liquid crystal units are charged. Thus, an angle wave module is disposed between a timing controller and a gate driving circuit by a supplier, and the angle wave module is adapted to generating angle waves at the start signals, whereby the affection of the electrical impedance of the increased liquid crystal units is decreased, voltage waveforms of standard work signals which is provided to the liquid crystal units are kept, and the electrical charges can be balanced when the liquid crystal units are charged.

In order to generating angle waves, the voltage of the start signal at a high voltage level is changed in a discharging manner by the angle wave module, and a discharging slope can be controlled by designing resistors and capacitors. However, the electrical energy of the start signal can be consumed and not fully utilized during the discharging process, and thus the energy-saving requirement of a green product cannot be met at present and in the future.

Accordingly, there exists a need for a scanning circuit and a method, which can fully utilize the electrical energy of the gate driving signals, generate angle waves and be capable of solving the above-mentioned problems.

SUMMARY OF THE INVENTION

It is an objective of the present invention to provide a liquid crystal panel, a scanning circuit and a method, which can fully utilize the electrical energy of the gate driving signals and generate angle waves.

In order to achieve the objective, the present invention provides a scanning circuit for generating angle waves. The scanning circuit for generating angle waves includes a scanning module and a plurality of angle wave modules. The scanning module has a plurality of scan output ends for outputting scan driving signals respectively in order, wherein the scan driving signal includes a first voltage and a second voltage. The angle wave modules are electrically connected to the scan output ends respectively in order, wherein each angle wave module includes a selecting unit and a controlling unit. The selecting unit includes a scan input end for periodically receiving the first voltage and the second voltage. The controlling unit includes a first output end and a second output end, and is electrically connected to the selecting unit for receiving a first control signal and a second control signal. When the scan input end receives the first voltage, the selecting unit generates the first control signal according to the first voltage, and the first output end outputs a gate driving signal according to the first control signal; when the voltage received the scan input end is decreased from the first voltage to the second voltage, the selecting unit shut off the first control signal and then generates the second control signal, and the second output end receives a part of electrical energy of the first output end according to the second control signal, whereby the first output end outputs an angle wave; and the selecting unit shuts off the second control signal and then generates a third control signal after the first output end outputs the angle wave, and the first output end outputs a gate off signal according to the third control signal. The second output end of the controlling unit of each angle wave module is electrically connected the first output end of the controlling unit of next one of the angle wave modules, whereby the part of electrical energy received by the second output end of the controlling unit of the angle wave modules is transmitted to the first output end of the controlling unit of the next one of the angle wave modules.

The present invention further provides a method for generating angle waves, the method including the following steps of: inputting a first voltage to a first angle wave module, whereby a selecting unit of the first angle wave module generates a first control signal according to the first voltage, and a first output end of a controlling unit of the first angle wave module outputs a gate driving signal according to the first control signal; when the first voltage is decreased to a second voltage, shutting off the first control signal and then generating a second control signal by the selecting unit of the first angle wave module, receiving a part of electrical energy of the first output end by the second output end of the first angle wave module according to the second control signal, and transmitting the part of electrical energy to a first output end of a controlling unit of the second angle wave module, whereby the first output end of the first angle wave module outputs an angle wave; and after the first output end of the first angle wave module outputs the angle wave, shutting off the second control signal and then generating a third control signal by the selecting unit of the first angle wave module, and outputting a gate off signal by the first output end of the first angle wave module according to the third control signal.

The present invention further provides a liquid crystal panel including: a scanning circuit for generating angle waves; and a plurality of gate lines electrically connected to the first output end of the first angle wave module of the scanning circuit respectively in order.

According to the liquid crystal panel, the scanning circuit and the method for generating angle waves in the present invention, the voltage of the first output end of the preceding angle wave module is divided so as to recycle the removed electrical energy of the preceding angle wave module because of generating the angle wave. Also, the removed electrical energy is recycled to the first output end of the succeeding angle wave module, i.e., electric charge released by the preceding angle wave module can be utilized to pre-charge the succeeding gate line, thereby providing pixels of a liquid crystal display with charge in advance, decreasing the whole power consumption of the liquid crystal display, and meeting the energy-saving requirement of a green product.

In order to make the aforementioned and other objectives, features and advantages of the present invention comprehensible, embodiments are described in detail below with reference to the accompanying drawings.

DETAILED DESCRIPTION OF THE INVENTION

Figure 1:
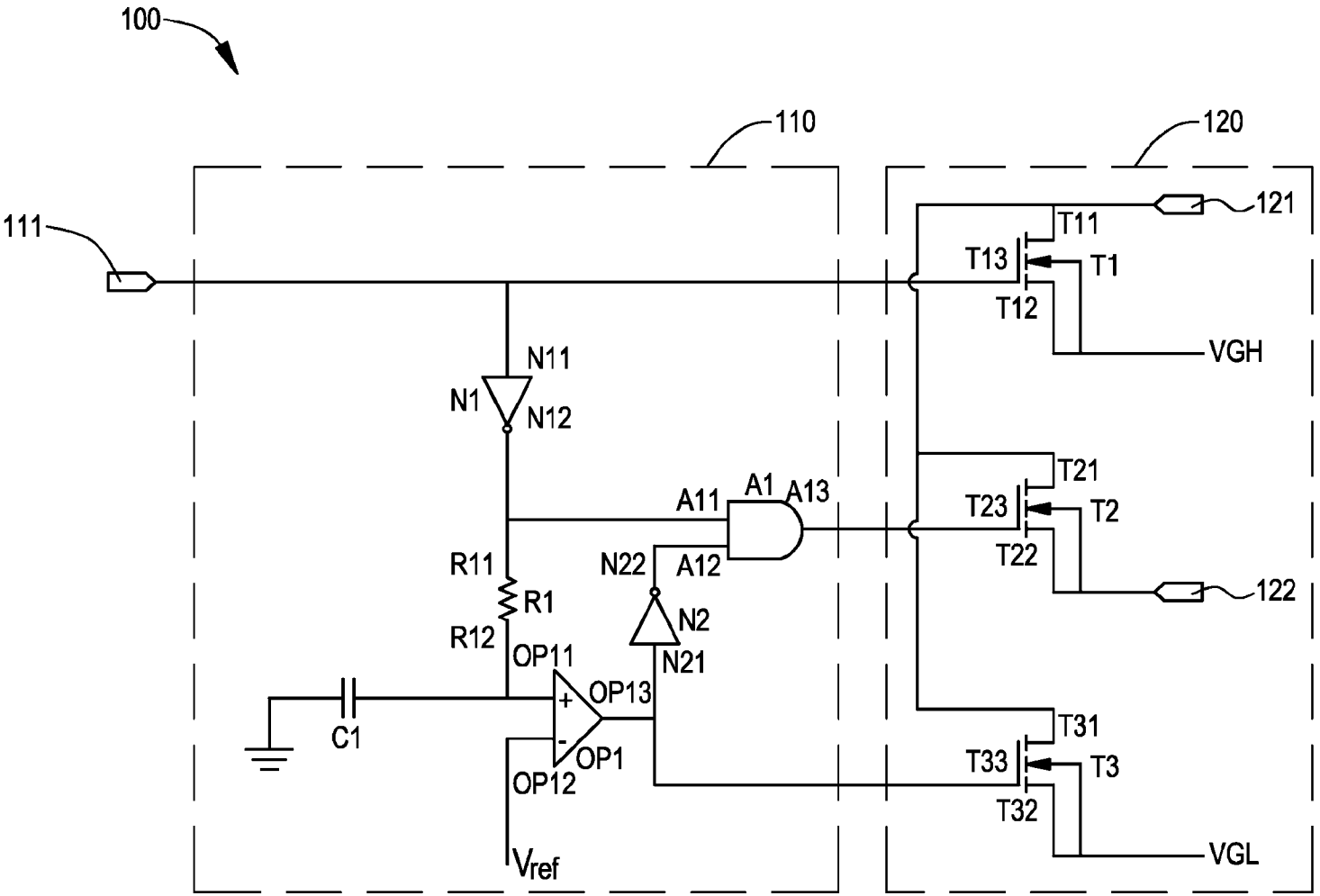
FIG. 1 is a circuit diagram of an angle wave module according to an embodiment of the present invention.

FIG. 1 is a circuit diagram of an angle wave module according to an embodiment of the present invention. The angle wave module 100 is adapted to generate an angle wave. The angle wave module 100 includes a selecting unit 110 and a controlling unit 120. The selecting unit 110 includes a scan input end 111, a first inverter N1, a second inverter N2, a resistor R1, a capacitor C1, a comparator OP1 and an AND gate A1. The scan input end 111 is adapted to periodically receive the first voltage and the second voltage. When the scan input end 111 receives the first voltage, the selecting unit 110 generates a first control signal according to the first voltage. When the voltage received the scan input end 111 is decreased from the first voltage to the second voltage, the selecting unit 110 shuts off the first control signal and then generates the second control signal. After the first output end 121 of the controlling unit 120 outputs the angle wave, the selecting unit 110 shuts off the second control signal and then generates a third control signal.

An input end N11 of the first inverter N1 is electrically connected to the scan input end 111. A first end R11 of the resistor R1 is electrically connected to an output end N12 of the first inverter N1. An end of the capacitor C1 is electrically connected to a second end R12 of the resistor R1. A positive end OP11 of the comparator OP1 is electrically connected to the second end R12 of the resistor R1, a negative end OP12 of the comparator OP1 is adapted to receive a reference signal Vref, and an output end OP13 of the comparator OP1 is adapted to output the third control signal. An input end N21 of the second inverter N2 is electrically connected to the output end OP13 of the comparator OP1. A first end A11 of the AND gate A1 is electrically connected to the output end N12 of the first inverter N1, a second end A12 of the AND gate A1 is electrically connected to the output end N22 of the second inverter N2, and an output end A13 of the AND gate A1 is adapted to output the second control signal.

The controlling unit 120 includes the first output end 121, a second output end 122, a first switch T1, a second switch T2 and a third switch T3. The controlling unit 120 is electrically connected to the selecting unit 110 for receiving the first control signal, the second control signal, and the third control signal.

A control end T13 of the first switch T1 is electrically connected to the input end N11 of the first inverter N1 for receiving the first control signal. A first end T11 of the first switch T1 is electrically connected to the first output end 121. A second end T12 of the first switch T1 is adapted to receiving a gate driving signal VGH. A control end T23 of the second switch T2 is electrically connected to the output end A13 of the AND gate A1 for receiving the second control signal. A first end T21 of the second switch T2 is electrically connected to the first end T11 of the first switch T1. A second end T22 of the second switch T2 is electrically connected to the second output end 122. A control end T33 of the third switch T3 is electrically connected to the output end OP13 of the comparator OP1 for receiving the third control signal. A first end T31 of the third switch T3 is electrically connected to the first end T11 of the first switch T1. A second end T32 of the third switch T3 is adapted to receiving a gate off signal VGL.

In this embodiment, the first switch T1, the second switch T2 and the third switch T3 can be Metal-Oxide-Semiconductor Field-Effect Transistors (MOSFETs) having N type channels.

Figure 3:
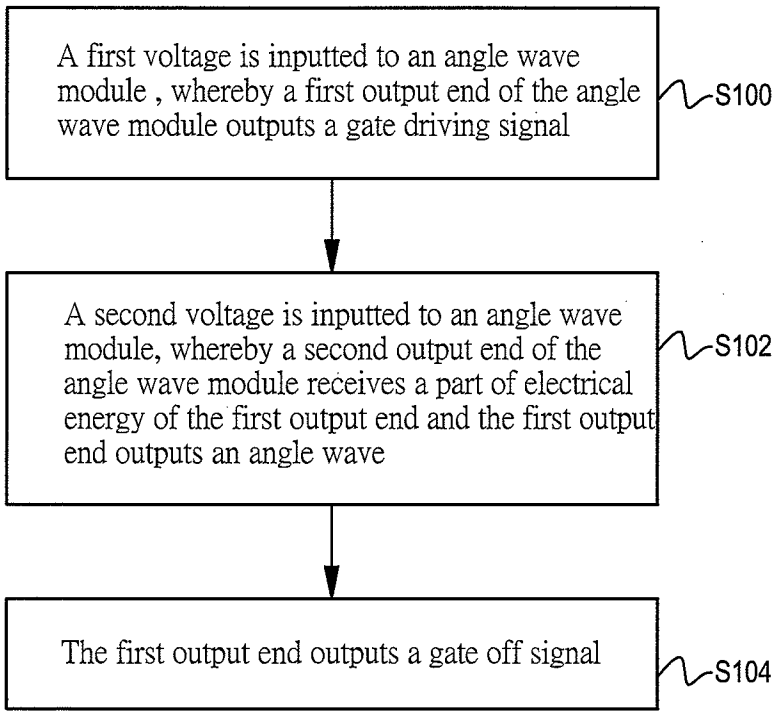
FIG. 3 is a flow chart of a method for generating angle waves according to an embodiment of the present invention.
Figure 2:
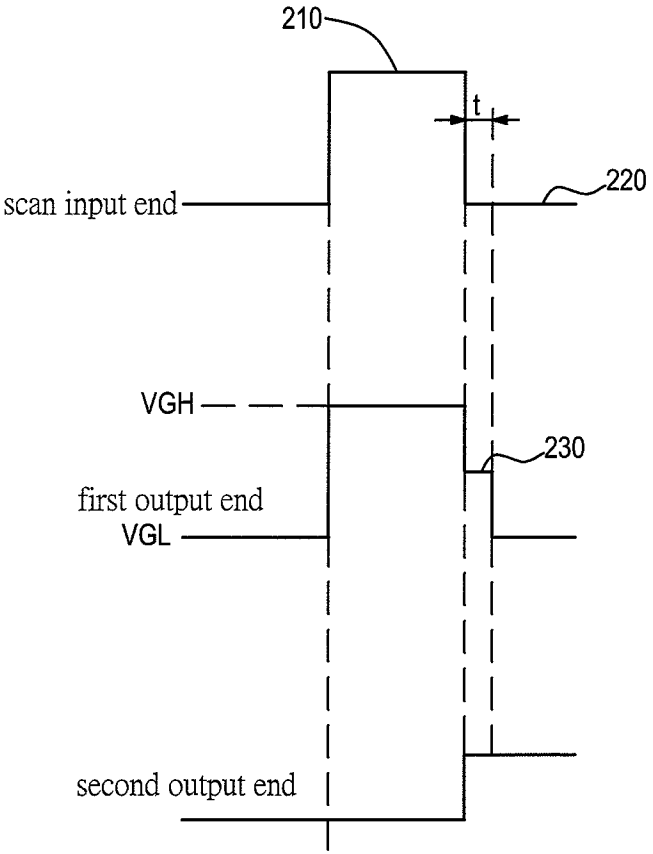
FIG. 2 shows waveforms of a scan input end, a first output end and a second output end of the angle wave module of FIG. 1.

FIG. 2 shows waveforms of a scan input end, a first output end and a second output end of the angle wave module of FIG. 1. FIG. 3 is a flow chart of a method for generating angle waves according to an embodiment of the present invention. Referring to FIGS. 1, 2 and 3 simultaneously, the method for generating angle waves includes the following steps.

In step S100, a first voltage 210 is inputted to an angle wave module 100, whereby a first output end 121 of a controlling unit 120 of the angle wave module 100 outputs a gate driving signal VGH. In this step, when the scan input end 111 receives the first voltage 210 (at the high voltage level), the selecting unit 110 generates a first control signal according to the first voltage 210. In this embodiment, an output end N12 of the first inverter N1 is at the low voltage level. A positive end OP11 of the comparator OP1 is at the low voltage level because the positive end OP11 of the comparator OP1 is electrically connected to the output end N12 of the first inverter N1. Also, the voltage of a reference voltage Vref is higher than the voltage of the positive end OP11, and thus an output end OP13 of the comparator OP1 is at the low voltage level. An input end N21 of the second inverter N2 is at the low voltage level, and thus an output end N22 of the second inverter N2 is at the high voltage level. A first end A11 of the AND gate A1 is at the low voltage level, a second end A12 of the AND gate A1 is at the high voltage level, and thus an output end A13 of the AND gate A1 is at the low voltage level. As described above, the first voltage 210 is the first control signal outputted by the selecting unit 110.

The first switch T1 is switched on, because the first control signal is at the high voltage level. The second switch T2 and the third switch T3 is switched off because of the low voltage level. Thus, the first output end 121 outputs the gate driving signal VGH according to the first control signal.

In step S102, a second voltage 220 is inputted to an angle wave module 100, whereby a second output end 122 of the controlling unit 120 of the angle wave module 100 receives a part of electrical energy of the first output end 121 and the first output end 121 outputs an angle wave 230. In this step, when an input signal (i.e., voltage) received the scan input end 111 is decreased from the first voltage 210 (at the high voltage level) to the second voltage 220 (at the low voltage level), the selecting unit 110 shuts off the first control signal and then generates a second control signal, and the second output end 122 receives the part of electrical energy of the first output end 121 according to the second control signal, whereby the first output end 121 outputs the angle wave 230. In this embodiment, the output end N12 of the first inverter N1 is at the high voltage level, and thus start to charge a capacitor C1. The voltage of the positive end OP11 of the comparator OP1 depends on the voltage of the capacitor C1. When the capacitor C1 is charged within a keeping time t, the voltage of the positive end OP11 is still smaller than the voltage of the negative end OP12. Thus, the output end OP13 of the comparator OP1 is at the low voltage level, and the output end N22 of the second inverter N2 is at the high voltage level. The first end A11 of the AND gate A1 is at the high voltage level, the second end A12 of the AND gate A1 is at the high voltage level, and thus the output end A13 of the AND gate A1 is at the high voltage level. As described above, the second control signal outputted by the output end A13 of the AND gate A1 is at the high voltage level.

The first switch T1 and the third switch T3 is switched off because of the low voltage level. The second switch T2 is switched on because of the high voltage level, whereby the second output end 122 is electrically conducted to the first output end 121, the second output end 122 receives the part of electrical energy of the first output end 121, and the first output end 121 outputs the angle wave 230. The keeping time t of the angle wave 230 depends on the resistor R1 and the capacitor C1, and a slope of the angle wave 230 depends on an equivalent resistance value of the first output end 121 and the second output end 122. The equivalent resistance value of the first output end 121 and the second output end 122 is very small, and thus the second output end 122 directly receives the part of electrical energy of the first output end 121.

In step S104, the first output end 121 outputs a gate off signal VGL. In this step, after the first output end 121 outputs the angle wave 230, the selecting unit 110 shuts off the second control signal and then generates a third control signal, and the first output end 121 outputs the gate off signal VGL according to the third control signal. In this embodiment, when the voltage received the scan input end 111 is kept to the second voltage 220 (at the low voltage level) and the capacitor C1 is charged behind the keeping time t, the output end N12 of the first inverter N1 doesn't stop charging the capacitor C1 until the voltage of the positive end OP11 is higher than the voltage of the negative end OP12, whereby the output end OP13 of the comparator OP1 is at the high voltage level, and the output end N22 of the second inverter N2 is at the low voltage level. The first end A11 of the AND gate A1 is at the high voltage level, the second end A12 of the AND gate A1 is at the low voltage level, and thus the output end A13 of the AND gate A1 is at the low voltage level. As described above, the third control signal outputted by the output end OP13 of the comparator OP1 is at the high voltage level.

The first switch T1 and the second switch T2 is switched off because of the low voltage level. The third switch T3 is switched on because of the high voltage level, whereby the first output end 121 outputs the gate off signal VGL.

Figure 4:
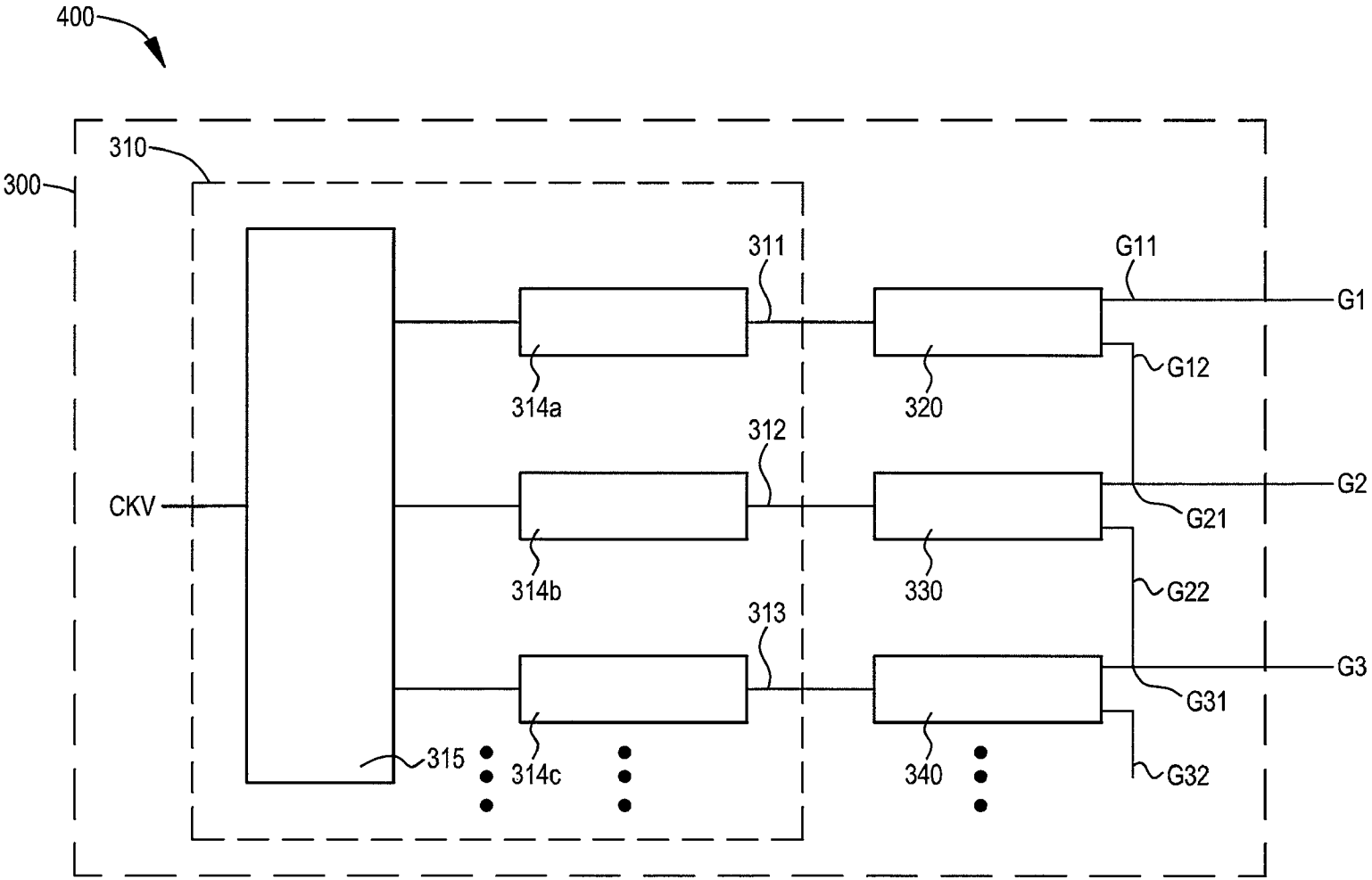
FIG. 4 is a circuit diagram of a liquid crystal panel according to an embodiment of the present invention.

FIG. 4 is a circuit diagram of a liquid crystal panel according to an embodiment of the present invention. The liquid crystal panel 400 includes a scanning circuit 300 for generating angle waves and a plurality of gate lines G1, G2, G3. The scanning circuit 300 for generating angle waves is adapted to outputs scan driving signals to the gate lines G1, G2, G3. The scanning circuit 300 for generating angle waves includes a scanning module 310 and a plurality of angle wave modules (e.g., the first angle wave module 320, the second angle wave module 330 and the third angle wave module 340). The scanning module 310 has a plurality of scan output ends for outputting the scan driving signals respectively in order, wherein the scan driving signal includes a first voltage and a second voltage. The angle wave modules are electrically connected to the scan output ends respectively in order (e.g., the first angle wave module 320 is electrically connected to the first scan output end 311, the second angle wave module 330 is electrically connected to the second scan output end 312, and the third angle wave module 340 is electrically connected to the third scan output end 313). The scanning module 310 includes a scanning unit 315 and a plurality of level adjusters 314*a*, 314*b*, 314*c*. The scanning unit 315 is adapted to outputs scan signals. Each of the level adjusters 314*a*, 314*b*, 314*c* is electrically connected to the scanning unit 315 for receiving the scan signal, changing voltage amplitude and voltage level of the scan signal and outputting the scan driving signal according to a frequency of the scan signal. The gate lines G1, G2, G3 are electrically connected to first output ends G11, G21, G31 of the angle wave modules 320, 330, 340 of the scanning circuit 300 respectively in order.

In order to conveniently describe, FIG. 4 only shows three level adjusters and three angle wave modules, i.e., the first angle wave module 320, the second angle wave module 330, and the third angle wave module 340. Each of the level adjusters 314*a*, 314*b*, 314*c* has a scan input end, i.e., the level adjuster 314*a* has a first scan input end 311, the level adjuster 314*b* has a second scan input end 312, and the level adjuster 314*c* has a third scan input end 313. Each of the angle wave module 320, 330, 340 has a first output end G11, G21, G31 and a second output end G12, G22, G32. The second output end of one of the angle wave modules is electrically connected the first output end of next one of the angle wave modules (e.g., the second output end G12 of the first angle wave module 320 is electrically connected the first output end G21 of the second angle wave module 330). In this embodiment, the circuit structure of the first angle wave module 320, the second angle wave module 330, and the third angle wave module 340 shown in FIG. 4 are the same as that of the angle wave module 100 shown in FIG. 1.

Figure 5:
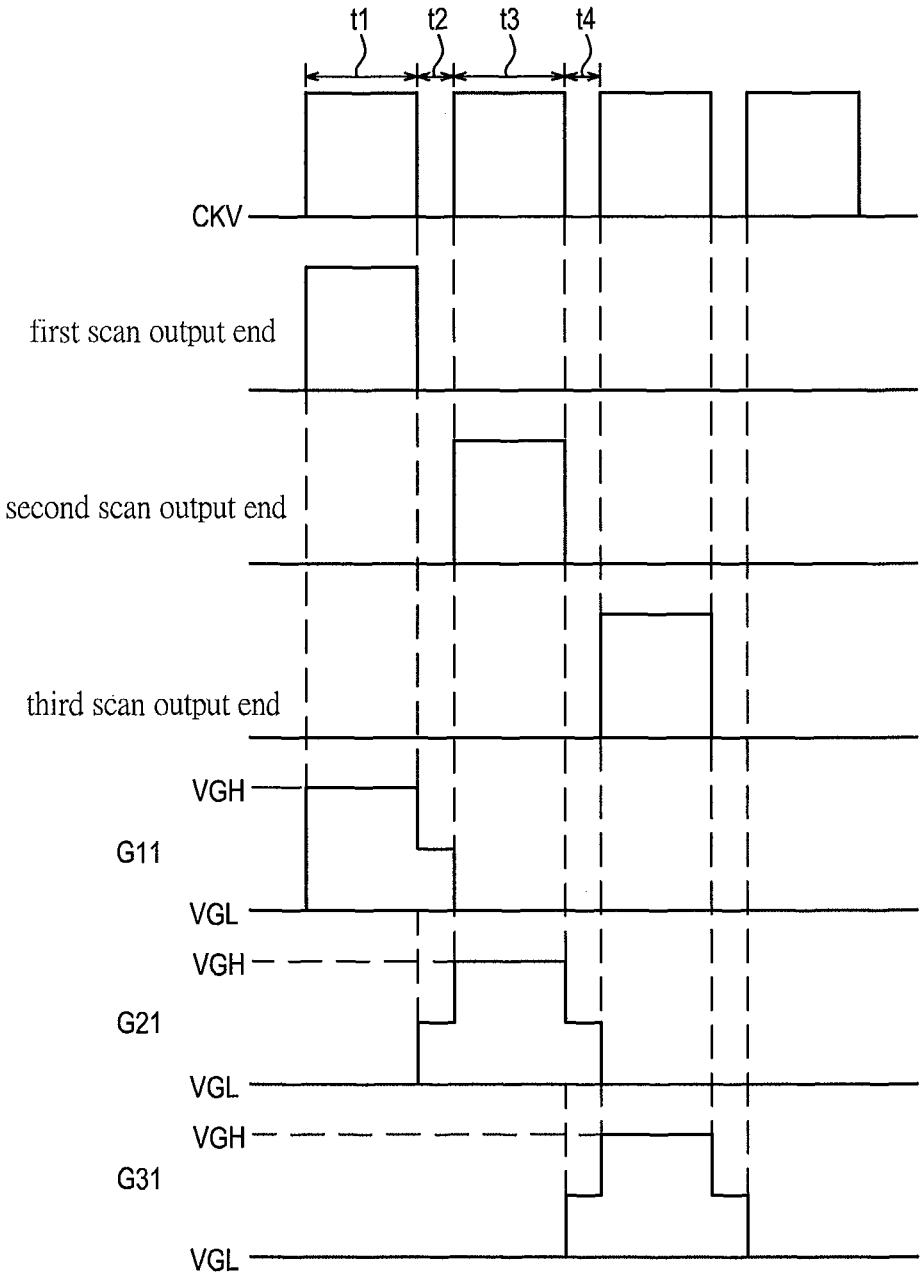
FIG. 5 shows waveforms of a clock signal, a first scan output end, a second scan output end, a third scan output end and first output ends of the scanning circuit of the crystal panel of FIG. 4.

FIG. 5 shows waveforms of a clock signal, a first scan output end, a second scan output end, a third scan output end, and first output ends of the scanning circuit of the crystal panel of FIG. 4. The actions of the scanning circuit 300 for generating angle waves at the first time period t1, the second time period t2, the third time period t3 and the fourth time period t4 shown in FIG. 4 are described below. Referring to FIGS. 4 and 5 simultaneously, when the scanning unit 315 receives a clock signal CKV at the first time period t1, the scan driving signal outputted by the scan input end 311 is the first voltage and at the high voltage level. Thus, when the first voltage is inputted to the first angle wave module 320, the first output end G11 of the first angle wave module 320 outputs the gate driving signal VGH to the gate line G1.

At the second time period t2, the scan driving signal outputted by the scan input end 311 is the second voltage and at the low voltage level. Thus, when the second voltage is inputted to the first angle wave module 320, the second output end G12 is electrically contacted with the first output end G11, whereby the second output end G12 of the first angle wave module 320 directly receives a part of electrical energy of the first output end G11, and the part of electrical energy is transmitted to the first output end G21 of the second angle wave module 330 and the gate line G2. At the moment, the signal outputted by the first output end G21 of the second angle wave module 330 is the same as the first output end G11 of the first angle wave module 320, and the first output end G11 of the first angle wave module 320 outputs the angle wave. As a result, the voltage of the first output end G11 of the preceding angle wave module (the first angle wave module 320) is divided so as to recycle the removed electrical energy of the preceding angle wave module (the first angle wave module 320) because of generating the angle wave. Also, the removed electrical energy is recycled to the first output end G21 of the succeeding angle wave module (the second angle wave module 330), i.e., electric charge released by the preceding angle wave module (the first angle wave module 320) can be utilized to pre-charge the succeeding gate line G2.

At the third time period t3, the scan driving signal outputted by the second scan output end 312 is at the high voltage level, and the first output end G21 of the second angle wave module 330 outputs the gate driving signal VGH. The first output end G11 of the first angle wave module 320 outputs the gate off signal VGL to the gate line G1.

At the fourth time period t4, the scan driving signal outputted by the second scan output end 312 is at the low voltage level, and the second output end G22 directly receives a part of electrical energy of the first output end G21, and the part of electrical energy is transmitted to the first output end G31 of the third angle wave module 340 and the gate line G3. Also, the second output end G22 is electrically contacted with the first output end G31 of the third angle wave module 340, and thus the signal outputted by the first output end G31 of the third angle wave module 340 is the same as the first output end G21 of the second angle wave module 330.

Then, the succeeding angle wave modules can periodically output the gate driving signal VGH, the angle wave and the gate off signal VGL according to the above-mentioned actions at the second time period t2 to the fourth time period t4.

In conclusion, according to the liquid crystal panel, the scanning circuit and the method for generating angle waves in the present invention, the voltage of the first output end of the preceding angle wave module is divided so as to recycle the removed electrical energy of the preceding angle wave module because of generating the angle wave. Also, the removed electrical energy is recycled to the first output end of the succeeding angle wave module, i.e., electric charge released by the preceding angle wave module can be utilized to pre-charge the succeeding gate line, thereby providing pixels of a liquid crystal display with charge in advance, decreasing the whole power consumption of the liquid crystal display, and meeting the energy-saving requirement of a green product.

To sum up, the implementation manners or embodiments of the technical solutions adopted by the present invention to solve the problems are merely illustrative, and are not intended to limit the scope of the present invention. Any equivalent variation or modification made without departing from the scope or spirit of the present invention shall fall within the appended claims of the present invention.

What is claimed is:

1. A scanning circuit for generating angle waves comprising:

a scanning module having a plurality of scan output ends for outputting scan driving signals respectively in order, wherein the scan driving signal includes a first voltage and a second voltage; and a plurality of angle wave modules electrically connected to the scan output ends respectively in order, wherein each angle wave module comprises:

a selecting unit comprising a scan input end for periodically receiving the first voltage and the second voltage; and a controlling unit comprising a first output end and a second output end, and electrically connected to the selecting unit for receiving a first control signal and a second control signal, wherein:

when the scan input end receives the first voltage, the selecting unit generates the first control signal according to the first voltage, and the first output end outputs a gate driving signal according to the first control signal;

when the voltage received the scan input end is decreased from the first voltage to the second voltage, the selecting unit shut off the first control signal and then generates the second control signal, and the second output end receives a part of electrical energy of the first output end according to the second control signal, whereby the first output end outputs an angle wave; and the selecting unit shuts off the second control signal and then generates a third control signal after the first output end outputs the angle wave, and the first output end outputs a gate off signal according to the third control signal;

wherein the second output end of the controlling unit of each angle wave module is electrically connected the first output end of the controlling unit of next one of the angle wave modules, whereby the part of electrical energy received by the second output end of the controlling unit of the angle wave modules is transmitted to the first output end of the controlling unit of the next one of the angle wave modules; and the selecting unit comprises:

a first inverter comprising:

an input end electrically connected to the scan input end; and an output end;

a resistor comprising:

a first end electrically connected to the output end of the first inverter; and a second end;

a capacitor electrically connected to the second end of the resistor;

a comparator comprising:

a positive end electrically connected to the second end of the resistor;

a negative end adapted to receive a reference signal; and an output end adapted to output the third control signal;

a second inverter comprising:

an input end electrically connected to the output end of the comparator; and an output end; and an AND gate comprising:

a first end electrically connected to the output end of the first inverter;

a second end electrically connected to the output end of the second inverter; and an output end adapted to output the second control signal.

2. The scanning circuit of generating angle waves as claimed in claim 1, wherein the scanning module further comprises a plurality of level adjusters for outputting the scan driving signals.

3. The scanning circuit of generating angle waves as claimed in claim 1, wherein the controlling unit further comprises:

a first switch comprising:

a control end adapted to receive the first control signal;

a first end electrically connected to the first output end; and a second end adapted to receive the gate driving signal;

a second switch comprising:

a control end adapted to receive the second control signal;

a first end electrically connected to the first end of the first switch; and a second end electrically connected to the second output end; and a third switch comprising:

a control end adapted to receive the third control signal;

a first end electrically connected to the first end of the first switch; and a second end is adapted to receive the gate off signal.

4. The scanning circuit of generating angle waves as claimed in claim 3, wherein the first switch, the second switch and the third switch are Metal-Oxide-Semiconductor Field-Effect Transistors (MOSFETs) having N type channels.

5. A method for generating angle waves comprising the following steps of:

inputting a first voltage to a first angle wave module, whereby a selecting unit of the first angle wave module generates a first control signal according to the first voltage, and a first output end of a controlling unit of the first angle wave module outputs a gate driving signal according to the first control signal;

when the first voltage is decreased to a second voltage, shutting off the first control signal and then generating a second control signal by the selecting unit of the first angle wave module, receiving a part of electrical energy of the first output end by the second output end of the first angle wave module according to the second control signal, and transmitting the part of electrical energy to a first output end of a controlling unit of the second angle wave module, whereby the first output end of the first angle wave module outputs an angle wave; and after the first output end of the first angle wave module outputs the angle wave, shutting off the second control signal and then generating a third control signal by the selecting unit of the first angle wave module, and outputting a gate off signal by the first output end of the first angle wave module according to the third control signal;

wherein the selecting unit comprises:

a first inverter comprising:

an input end electrically connected to the scan input end; and an output end;

a resistor comprising:

a first end electrically connected to the output end of the first inverter; and a second end;

a capacitor electrically connected to the second end of the resistor;

a comparator comprising:

a positive end electrically connected to the second end of the resistor;

a negative end adapted to receive a reference signal; and an output end adapted to output the third control signal;

a second inverter comprising:

an input end electrically connected to the output end of the comparator; and an output end; and an AND gate comprising:

a first end electrically connected to the output end of the first inverter;

a second end electrically connected to the output end of the second inverter; and an output end adapted to output the second control signal.

6. A liquid crystal panel comprising:

a scanning circuit for generating angle waves, the scanning circuit comprising:

a scanning module having a plurality of scan output ends for outputting scan driving signals respectively in order, wherein the scan driving signal includes a first voltage and a second voltage; and a plurality of angle wave modules electrically connected to the scan output ends respectively in order, wherein each angle wave module comprises:

a selecting unit comprising a scan input end for periodically receiving the first voltage and the second voltage; and a controlling unit comprising a first output end and a second output end, and electrically connected to the selecting unit for receiving a first control signal and a second control signal, wherein:

when the scan input end receives the first voltage, the selecting unit generates the first control signal according to the first voltage, and the first output end outputs a gate driving signal according to the first control signal;

when the voltage received the scan input end is decreased from the first voltage to the second voltage, the selecting unit shut off the first control signal and then generates the second control signal, and the second output end receives a part of electrical energy of the first output end according to the second control signal, whereby the first output end outputs an angle wave; and the selecting unit shuts off the second control signal and then generates a third control signal after the first output end outputs the angle wave, and the first output end outputs a gate off signal according to the third control signal;

wherein the second output end of the controlling unit of each angle wave module is electrically connected the first output end of the controlling unit of next one of the angle wave modules, whereby the part of electrical energy received by the second output end of the controlling unit of the angle wave modules is transmitted to the first output end of the controlling unit of the next one of the angle wave modules; and the selecting unit comprises:

a first inverter comprising:

an input end electrically connected to the scan input end; and an output end;

a resistor comprising:

a first end electrically connected to the output end of the first inverter; and a second end;

a capacitor electrically connected to the second end of the resistor;

a comparator comprising:

a positive end electrically connected to the second end of the resistor;

a negative end adapted to receive a reference signal; and an output end adapted to output the third control signal;

a second inverter comprising:

an input end electrically connected to the output end of the comparator; and an output end; and an AND gate comprising:

a first end electrically connected to the output end of the first inverter;

a second end electrically connected to the output end of the second inverter; and an output end adapted to output the second control signal; and a plurality of gate lines electrically connected to the first output end of the first angle wave module of the scanning circuit respectively in order.

7. The liquid crystal panel as claimed in claim 6, wherein the scanning module comprises a plurality of level adjusters for outputting the scan driving signals.

8. The liquid crystal panel as claimed in claim 6, wherein the controlling unit further comprises:

a first switch comprising:

a control end adapted to receive the first control signal;

a first end electrically connected to the first output end; and a second end adapted to receiving the gate driving signal;

a second switch comprising:

a control end adapted to receive the second control signal;

a first end electrically connected to the first end of the first switch; and a second end electrically connected to the second output end; and a third switch comprising:

a control end adapted to receive the third control signal;

a first end electrically connected to the first end of the first switch; and a second end is adapted to receive the gate off signal.

* * * * *